US005452799A

United States Patent [19]

Sutherland

[11] Patent Number: 5,452,799

[45] Date of Patent: Sep. 26, 1995

[54] ARTICLE CARRIER WITH ROUNDED CORNERS

[75] Inventor: Robert L. Sutherland, Kennesaw, Ga.

[73] Assignee: Riverwood International Corporation, Atlanta, Ga.

[21] Appl. No.: 260,154

[22] Filed: Jun. 14, 1994

[51] Int. Cl.[6] ..... B65D 71/12

[52] U.S. Cl. ..... 206/427; 206/153

[58] Field of Search ..... 206/145–161, 206/427, 432, 433

[56] References Cited

U.S. PATENT DOCUMENTS

| | | | |
|---|---|---|---|
| 3,224,577 | 12/1965 | Hansen | 206/158 |
| 4,190,149 | 2/1980 | Oliff et al. | 206/145 |
| 4,304,329 | 12/1981 | Graser | 206/148 |
| 4,482,090 | 11/1984 | Milliens | 206/155 |
| 4,804,089 | 2/1989 | Wilson | 206/155 |
| 4,925,019 | 5/1990 | Ganz et al. | 206/145 |
| 5,058,735 | 10/1991 | Bienaime | 206/147 |
| 5,246,112 | 9/1993 | Stout et al. | 206/427 |
| 5,328,024 | 7/1994 | Sutherland | 206/158 |

FOREIGN PATENT DOCUMENTS

| | | | |
|---|---|---|---|
| 1118722 | 7/1968 | United Kingdom | 206/153 |
| 9314992 | 8/1993 | WIPO | 206/152 |
| 9404431 | 3/1994 | WIPO | 206/151 |

*Primary Examiner*—Jimmy G. Foster

[57] ABSTRACT

A carrier especially suited for carrying beverage cans. The carrier is comprised of a top panel connected to support panels which contain slots for receiving the can chimes. In addition, short side panel flaps connected to the support panels and end panel flaps connected to the top panel assist in holding the cans in place. Webs foldably connected to the side panel flaps and to extensions of the end panel flaps cause the end panel flaps to be automatically drawn into place. The side panel flaps, the webs and the end panel extensions are glued together to hold the carrier in locked condition.

10 Claims, 2 Drawing Sheets

ARTICLE CARRIER WITH ROUNDED CORNERS

FIELD OF THE INVENTION

This invention relates to carriers of the type that support articles from the underside of flanges or other lateral projections on the articles. More particularly, it relates to carriers of this type which have integral side and end panels.

BACKGROUND OF THE INVENTION

There are many different types of carriers for packaging flanged articles, such as beverage cans. Sleeve-type carriers completely enclose the cans and so have little problem with cans escaping from the package. The amount of stock required to form sleeve-type carrier blanks, however, makes the carriers relatively expensive.

Wrap-around carriers use less stock, but due to their open ends they can present a problem in keeping the cans from escaping from the package. Partial end panels have been added to assist in preventing outward movement of the cans, but this adds to the cost of the package and is not economically desirable.

Another type of can carrier is the clip-type which supports the cans from the underside of the can chimes or flanges. One design of a clip-type carrier is comprised of a panel containing apertures corresponding to the tops of the cans, with foldably connected tabs surrounding the apertures. The top portions of the cans extend through the apertures and the edges of the tabs engage the underside of the can chimes to support the cans. This produces an inherently weak carrier due to the fact that much of the panel is removed in forming the apertures. In addition, there is very little surface area capable of receiving printing or other graphics, and the provision of a handle for lifting the carrier further complicates the design and makes the carrier more expensive.

Another clip-type design makes use of slots in a panel for receiving opposite portions of the can chimes, with adjacent panel edges resulting from the slot formation engaging the underside of the can chime portions. This is typically employed in packages comprised of two adjacent rows of cans, so that the elongated area of the panel between the interior slots folds into a wedge-shaped reinforcing rib extending between the sloped upper portions of the cans. Such carriers provide substantially unbroken areas in the top panel for receiving printed indicia, but fall short of providing the desired level of strength and is relatively expensive to produce. Although clip-type carriers use less stock and so are more economical, neither design incorporates end panels, which makes the carriers potentially susceptible to outward movement of the end cans and which in any event permits some degree of movement or swinging motion of the cans when a person holding the carrier is walking. Although such movement may not result in the loss of any cans from the carrier, it produces an undesirable perception to the user that the cans are not tightly packaged.

It would be desirable to provide a carrier which retains the benefits of certain features of clip-type carriers, and in addition provides increased strength and economy of manufacture. Ideally, the carrier should include means to hold the cans in place separate from and supplementary to any can chime locking slots, and should be of a design which can be readily formed by a packaging machine.

BRIEF SUMMARY OF THE INVENTION

The carrier of the invention includes a downwardly extending support panel connected to each side edge of a top panel along a fold line, and each support panel contains slots through which at least portions of the projecting lips of the packaged articles protrude. End panel flaps connected to the opposite end edges of the top panel have extensions which extend around outer portions of adjacent articles, and side panel flaps connected to each support panel overlie end portions of the end panel flap extensions. A web further foldably connects each side panel flap to an associated end panel flap extension so as to be in face-to-face relationship with the interior face of the side panel flap and with the exterior face of the associated end panel flap extension.

This arrangement causes the end panel flaps to be automatically drawn into place upon pivotal movement of the side panel flaps of a carrier blank being formed into a carrier. Where the articles in the carrier are cans or otherwise include cylindrical portions extending at right angles to the top panel, the end panel flap extensions are able to conform to the rounded exterior of the corner articles in the carrier to snugly fit around the entire periphery of the package. The articles are thereby tightly held in place without danger of moving.

The features of the invention which enable it to provide the desired results are brought out in more detail in the description of the preferred embodiment, wherein the above and other aspects of the invention, as well as other benefits, will readily become apparent.

DETAILED DESCRIPTION OF THE PREFERRED EMBODIMENT

Figure 1:
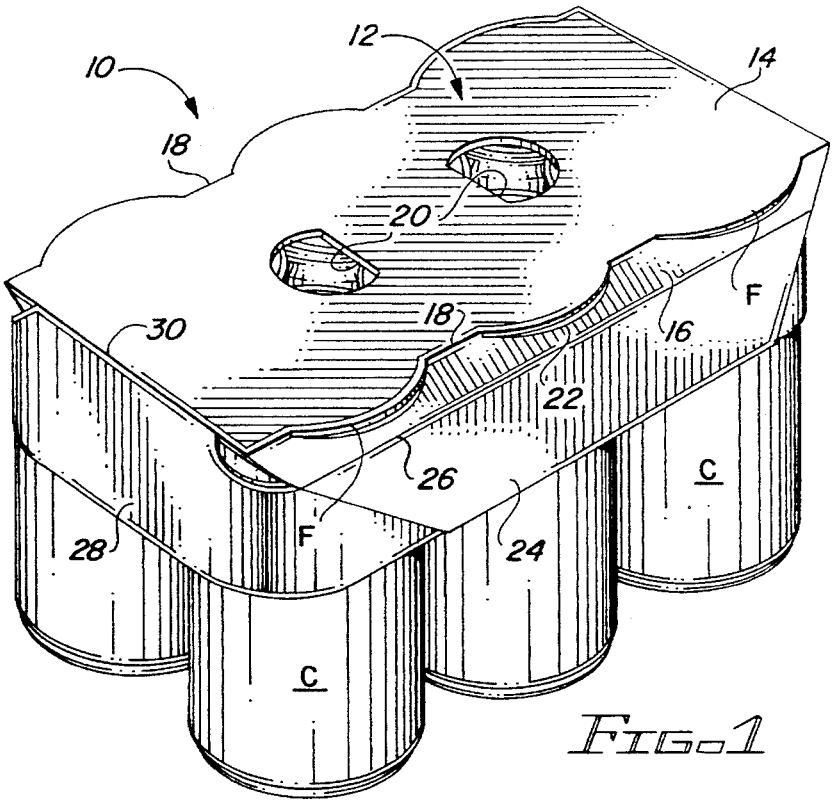
FIG. 1 is a pictorial view of a package of beverage cans formed by the carrier of the invention.
Figure 2:
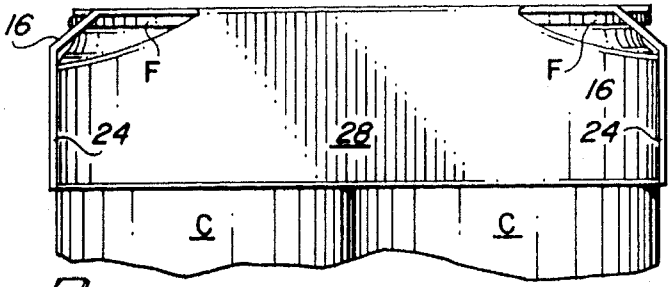
FIG. 2 is an enlarged partial end view of the carrier of FIG. 1.

Referring to FIGS. 1 and 2, a package 10 is illustrated which is comprised of the carrier 12 of the invention and two rows of cans C. The carrier includes a top panel 14 connected to sloped support sections 16 by fold lines 18. The central portion of the panel 14 includes finger holes 20 located above the spaces between cans. Slots 22 in support panels 16 receive the chimes or flanges F of the cans C, supporting the cans by the lower surface of the flanges.

The carrier also includes short side panels 24, connected to the sloped support panels 16 by fold lines 26, and short end panels 28, connected to the end edges of the top panel by fold lines 30. The cans are thus not only supported by their chimes, but are securely bound together about the entire periphery of the package by the combined side and end panels.

Figure 3:
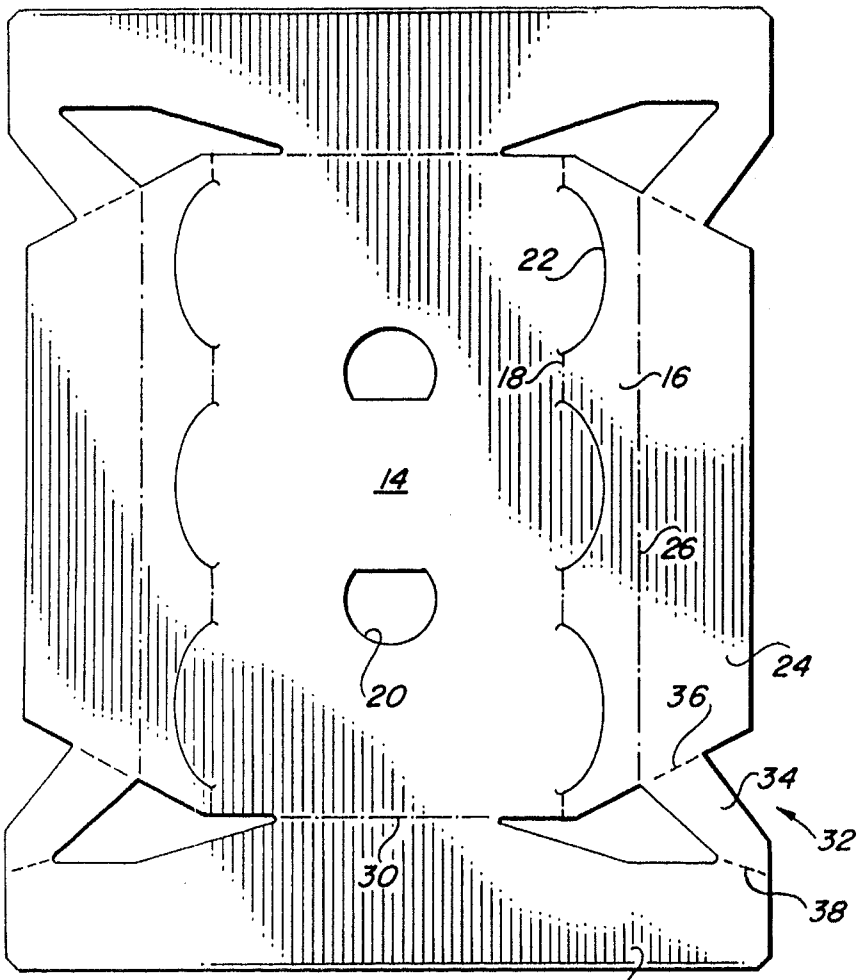
FIG. 3 is a plan view of a blank for forming the carrier of FIG. 1.

Referring now to FIG. 3, wherein like reference numerals to those used in FIGS. 1 and 2 denote like elements, a generally rectangular blank from which the carrier 12 is formed is indicated at 32. The material of the blank should possess sufficient strength and flexibility to allow it to be folded into carrier form and to withstand the loading caused by lifting and carrying the cans or other articles. Paperboard of the type and caliper conventionally employed in the carrier industry is preferred. The central portion of the blank is comprised of the top panel section 14, the fold lines 18 of which are interrupted by three curved, C-shaped slits 22 which form the slots of the carrier. The convex sides of the slits face toward the fold lines 26. The C-shaped slits may be made to terminate in arcuate ends slightly inwardly of their associated fold lines 18, if desired, to resist the tendency to tear at this stress point.

The blank includes a web or gusset panel 34 at each corner area of the blank. Each web is connected at one end to the end edge of an associated side panel flap 24 along fold line 36 and at the other end to an associated end panel flap 28 along fold line 38. The portion of each end panel flap to which the webs 34 are connected may be considered to be an extension or corner strap portion of the end panel flap which extends out beyond the side edges of the top panel section 14. Interior edges of the webs 34 and the end panel flaps 28 and an exterior edge portion of the top panel section 14 define cutouts 40 at each corner area of the blank. The fold lines 36 preferably form an acute angle with the associated fold line 26, while the angle between the fold lines 38 and the nearest fold line 26 is selected so as to be aligned with the fold line 26 in a carrier formed from the blank, as described in more detail below.

Figure 4:
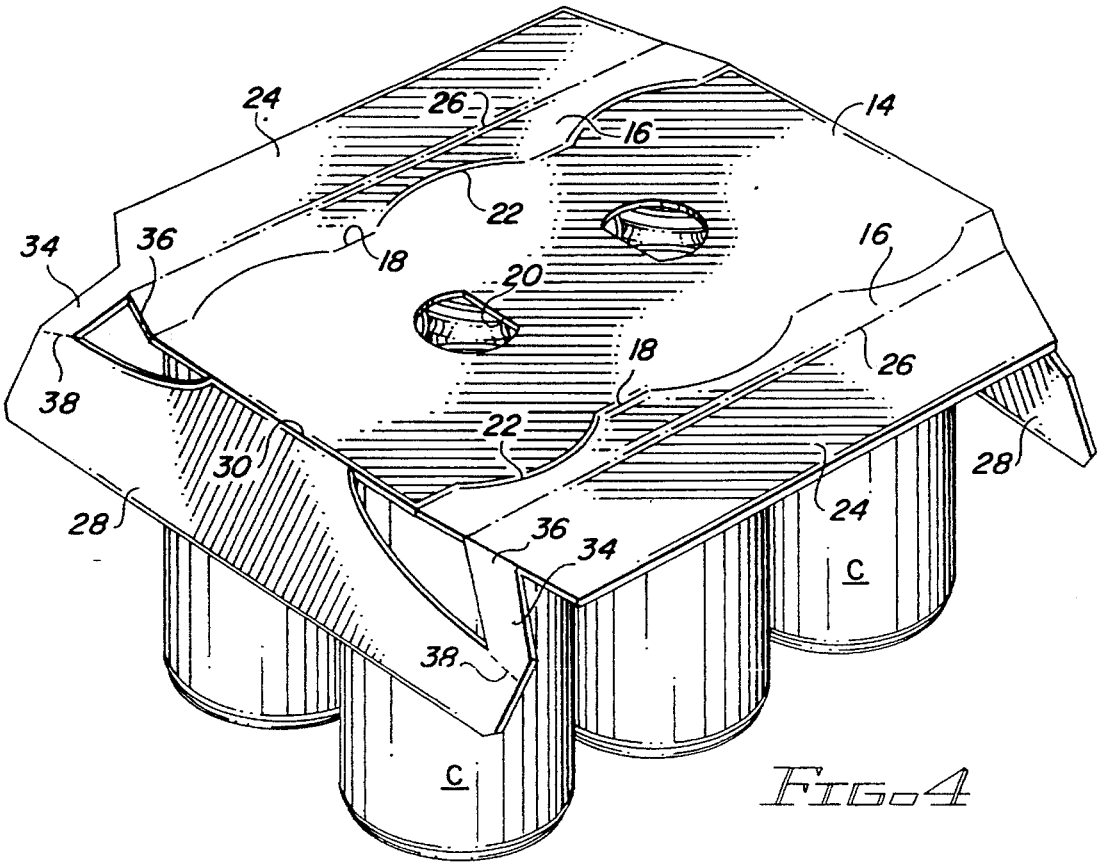
FIG. 4 is a pictorial view of the blank and cans to be packaged as they appear after the blank has been placed on the cans and initially folded.

To form a package containing beverage cans, the carrier blank is positioned on top of two rows of adjacent cans so that the C-shaped slits in the blank are substantially aligned with the outer portions of the rims or chimes of the cans. The end panel flaps 28 are then folded down about the fold lines 30, causing the webs 34 to move with the end panel flaps and pivot about the fold lines 36. The blank at this stage of carrier fabrication is illustrated in FIG. 4.

Figure 5:
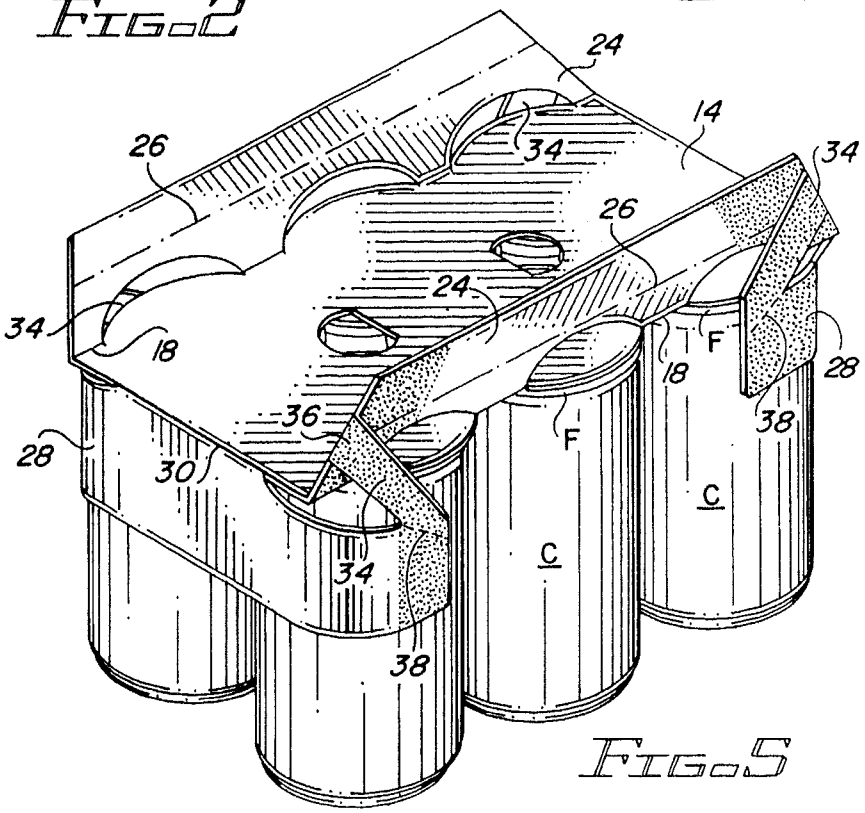
FIG. 5 is a pictorial view of the blank and cans at an intermediate stage of forming a carrier.

The support panel sections 16 and connected side panel flaps 24 are then pivoted up about the interrupted fold lines 18, as illustrated in FIG. 5. As the side panel flaps move up, the fold lines 36 and connected webs 34 move with them. This causes the webs 34 to fold down about the fold lines 36, drawing the ends of opposite end panel flaps 28 toward each other and pulling the end portions of the end panel flaps around the peripheries of the corner cans C to the position shown in FIG. 5. Movement of the end panel flaps in this manner moves the fold lines 38 into substantially horizontal position, aligned with and adjacent to the fold lines 26. This allows both the webs 34 and the side panel flaps 24 to fold down about their fold lines without interfering or conflicting with each other into the final position of the carrier shown in FIG. 1. As this takes place the edges of the slots in the support panels formed by the slits 22 snap into place beneath the can chimes to securely support the cans from the chimes. Prior to the folding of the side panel flaps the stippled surfaces of FIG. 5 on the side panel flaps 24, the gusset panel webs 34 and the end portions of the end panel flaps 28 will have been coated with glue to hold the side and end panels in place.

As a result of the upward pivoting movement of the side panel flaps during formation of the carrier, the corner strap extensions of the end panels are automatically drawn around the cans at the corners of the package, bringing them into position to be engaged by the underside of the side panel flaps 24. The cutouts 40 enable the folding action to take place by eliminating material which would otherwise bunch together and prevent a smooth continuation of the end panels around the corner cans. Adherence of the end panel flaps to the side panel flaps holds the carrier in locked condition so that the outer portions of the can chimes continue to be supported by the lower edge of the slots 22. The carrier thus combines the supporting features of a clip-type carrier with the holding power of side and end panels to provide an economical carrier capable of supporting and tightly holding cans or other flanged articles in place.

By making the angle between the web fold lines 36 and the fold line 26 an acute angle the upward pivoting movement of the side panel flaps that occurs during formation of a carrier causes the resulting folding action of the webs 34 at each end of a side panel flap to have a component of movement toward each other, thereby pulling the end panel flap extensions into place.

It will now be clear that the invention improves the strength of clip-type paperboard carriers without increasing their cost. Obviously, although the invention has been described in connection with a carrier designed to hold six beverage cans, the principles of the invention may be incorporated in carriers designed to hold fewer or more cans. Moreover, the invention is not limited to use with cans, but may be extended to other types of articles having a rim or other projection capable of being gripped by locking or supporting edges of the carrier.

Because the invention is not necessarily limited to all the specific details described in connection with the preferred embodiment, except as they may be within the scope of the appended claims, changes to certain features of the preferred embodiment which do not alter the overall basic function and concept of the invention are contemplated.

What is claimed is:

1. A carrier containing a plurality of articles, each article having an upper portion which includes an outwardly projecting lip, comprising:

a top panel having opposite side edges and opposite end edges;

a downwardly extending support panel connected to each side edge of the top panel along a fold line, the support panels containing slots through which at least portions of the projecting lips of the articles protrude;

end panel flaps connected to the opposite end edges of the top panel, the end panel flaps having extensions which extend around outer portions of adjacent articles;

a side panel flap connected to each support panel and overlying end portions of the end panel flap extensions; and each side panel flap being connected to an associated end panel flap extension by a web, the web being connected to the end panel flap extension by a first web fold line and to the side panel flap by a second web fold line.

2. A carrier as defined in claim 1, wherein the first fold line of each web extends substantially horizontally and is substantially aligned with a fold line connecting the associated side panel flap to an associated support panel.

3. A carrier as defined in claim 2, wherein the second fold line of each web is connected to the associated side panel flap along an outer end portion thereof.

4. A carrier as defined in claim 3, wherein the second fold lines form an acute angle with the fold line connecting an associated side panel flap to an associated support panel.

5. A carrier as defined in claim 2, wherein the webs are located between the side panel flaps and the adjacent end panel flap extension, each web being folded about its second fold line so as to be in face-to-face relationship with the interior face of the side panel flap, and about its first fold line so as to be in face-to-face relationship with the exterior face of the associated end panel flap extension.

6. A carrier as defined in claim 5, wherein the articles in the carrier include cylindrical portions extending at right angles to the top panel, the end panel flap extensions being curved about the cylindrical portions of adjacent articles.

7. A carrier as defined in claim 1, wherein the fold line connecting each downwardly extending support panel to the top panel is interrupted by the slots in the support panels.

8. A blank for forming a carrier for packaging a plurality of articles having an upper portion which includes an outwardly projecting lip, comprising:

a substantially rectangular blank;

a central top panel section having opposite side edges and opposite end edges;

a support panel section connected to each side edge of the top panel section along a fold line, the fold line being interrupted by slits which form slots in a carrier formed from the blank, such slots receiving portions of the outwardly projecting lip of an adjacent article in the carder;

end panel flaps connected to the opposite end edges of the top panel section, the end panel flaps having extensions for extending around outer portions of adjacent articles in a carrier formed from the blank;

a side panel flap connected to each support panel section;

each side panel flap being connected to an associated end panel flap extension by a web, the web being connected to the end panel flap extension by a first web fold line and to the side panel flap by a second web fold line, each side panel flap being connected to an associated support panel section by a fold line, the first fold line of each web extending at an angle to said side panel flap fold line such that said first web fold line is substantially aligned with an associated side panel flap fold line in a carrier formed from the blank.

9. A carrier blank as defined in claim 8, wherein the second fold line of each web connects the associated side panel flap along an outer end portion thereof.

10. A carrier blank as defined in claim 9, wherein the second fold line of each web forms an acute angle with the fold line connecting an associated side panel flap to an associated support panel section.

* * * * *